US011834918B2

(12) United States Patent
McLaughlin et al.

(10) Patent No.: US 11,834,918 B2
(45) Date of Patent: Dec. 5, 2023

(54) TUBING HANGER ORIENTATION SPOOL ADAPTOR

(71) Applicant: Dril-Quip, Inc., Houston, TX (US)

(72) Inventors: Daniel J. McLaughlin, Katy, TX (US); Gregory D. Williams, Houston, TX (US); Eleazar Herrera, Houston, TX (US); Morris B. Wade, Houston, TX (US); Todd Scaggs, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days.

(21) Appl. No.: 17/050,715

(22) PCT Filed: Apr. 22, 2019

(86) PCT No.: PCT/US2019/028483
§ 371 (c)(1),
(2) Date: Oct. 26, 2020

(87) PCT Pub. No.: WO2019/209698
PCT Pub. Date: Oct. 31, 2019

(65) Prior Publication Data

US 2021/0238937 A1 Aug. 5, 2021

Related U.S. Application Data

(60) Provisional application No. 62/663,459, filed on Apr. 27, 2018.

(51) Int. Cl.
*E21B 19/24* (2006.01)
*E21B 19/00* (2006.01)
*E21B 43/013* (2006.01)

(52) U.S. Cl.
CPC ..... *E21B 19/24* (2013.01); *E21B 19/00* (2013.01); *E21B 43/013* (2013.01)

(58) Field of Classification Search
None
See application file for complete search history.

(56) References Cited

U.S. PATENT DOCUMENTS 5,975,210 A * 11/1999 Wilkins ..... E21B 33/038 166/341
7,063,157 B2 * 6/2006 Bartlett ..... E21B 23/00 166/345

(Continued)

FOREIGN PATENT DOCUMENTS

EP 0611874 P 8/1994

OTHER PUBLICATIONS

International Search Report and Written Opinion issued in related PCT Application No. PCT/US2019/028483 dated Aug. 21, 2019, 11 pages.

(Continued)

*Primary Examiner* — Matthew R Buck
*Assistant Examiner* — Douglas S Wood
(74) *Attorney, Agent, or Firm* — Baker Botts L.L.P.

(57) ABSTRACT

Systems and methods for proper orientation of the connections of a tubing hanger and a subsea assembly in a wellhead or tree are provided. The alignment is accomplished with the use of an orientation spool adaptor equipped with positional sensors and an orientation helix. Calibration of the positional sensors at the surface allows for orientation with simple vertical deployment. Positional sensors may provide real time data such as location, speed of installation and orientation back to the surface.

20 Claims, 2 Drawing Sheets

(56) References Cited

U.S. PATENT DOCUMENTS

| | | | | |
|---|---|---|---|---|
| 7,770,650 | B2 * | 8/2010 | Young | E21B 23/004 166/344 |
| 8,061,428 | B2 * | 11/2011 | Fenton | E21B 33/04 166/347 |
| 8,955,594 | B2 * | 2/2015 | Bell | E21B 33/035 166/341 |
| 10,947,805 | B2 * | 3/2021 | DeBerry | E21B 33/043 |
| 11,421,501 | B2 * | 8/2022 | Murphy | E21B 33/035 |
| 2008/0017383 | A1 | 1/2008 | Minassian et al. | |
| 2013/0292127 | A1 | 11/2013 | Fenton | |
| 2014/0054044 | A1 | 2/2014 | Nellessen, Jr. et al. | |
| 2015/0159458 | A1 * | 6/2015 | Tan | E21B 33/0407 166/348 |
| 2015/0259990 | A1 * | 9/2015 | June | E21B 19/24 166/341 |
| 2018/0163520 | A1 * | 6/2018 | Navar | E21B 33/0355 |
| 2021/0095540 | A1 * | 4/2021 | Murphy | E21B 23/00 |

OTHER PUBLICATIONS

International Preliminary Report on Patentability issued in related PCT Application No. PCT/US2019/028483 dated Nov. 5, 2020, 8 pages.

* cited by examiner

TUBING HANGER ORIENTATION SPOOL ADAPTOR

CROSS-REFERENCE TO RELATED APPLICATION

The present application is a U.S. National Stage Application of International Application No. PCT/US2019/028483 filed Apr. 22, 2019, which claims priority to U.S. Provisional Application Ser. No. 62/663,459 filed on Apr. 27, 2018, both of which are incorporated herein by reference in their entirety for all purposes.

TECHNICAL FIELD

The present disclosure relates generally to wellhead systems and, more particularly, to an orientation adaptor, which includes optical sensors that ensure proper alignment of the compatible connections of a tubing hanger and a subsea assembly such as a tree.

BACKGROUND

Conventional wellhead systems include a wellhead housing mounted on the upper end of a subsurface casing string extending into the well bore. The wellhead housing typically includes subsea assemblies such as casing and tubing spools. Sometimes subsea well sites will implement a horizontal Christmas tree, which sits on the wellhead housing throughout drilling and completion. During drilling and completion, a drilling riser and blowout preventer ("BOP") stack are installed above the wellhead housing or horizontal Christmas tree. The BOP stack provides pressure control as casing and tubing strings are installed downhole. During production tubing installation, the tubing hanger connects to the upper end of the tubing string and is typically landed either in the wellhead housing or the horizontal tree. For tubing hangers landed in the wellhead housing, a vertical Christmas tree is connected to the tubing hanger.

Tubing hangers contain numerous conduits and couplings, which require precise alignment with complementary conduits and couplings of a subsea assemblies such as Christmas trees and completions. Tubing hanger alignment devices typically use an orientation sleeve inside of a wellhead component. Orientation sleeves usually passively rotate tubing hangers to the desired alignment before landing. These passive orientation mechanisms provide minimal feedback to operators about the location, speed of installation, orientation of subsea assemblies, or their orientation with respect to other subsea assemblies.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system-related and business-related constraints, which will vary from one implementation to another. Moreover, it will be appreciated that such a development effort might be complex and time consuming but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to an orientation spool adaptor used to align compatible connections between a tubing hanger and other subsea assemblies. In wellhead systems, tubing hangers and other subsea assemblies must be properly aligned as each assembly is connected to the wellhead system during drilling and completion operations. This is because tubing hangers house various hydraulic, electric, and/or fiber optic connections which interface with complimentary connections of various subsea assemblies that are connected to the tubing hanger as the wellhead is prepared for production.

Existing methods rely on passive mechanical features to orient the connections between a tubing hanger and a subsea assembly. The present disclosure is directed to systems and methods for aligning connections contained in subsea assemblies in wellhead systems using positional sensors integrated in an orientation spool adaptor. The position sensors of the orientation adaptor guide orientation of tubing hangers and other subsea assemblies to a desired position during simple vertical deployment. The sensors also provide real-time feedback on location, speed of installation, and orientation of the tubing hanger back to the surface. The sensors may also be implemented to self-orient the spool adaptor during installation.

Figure 1:
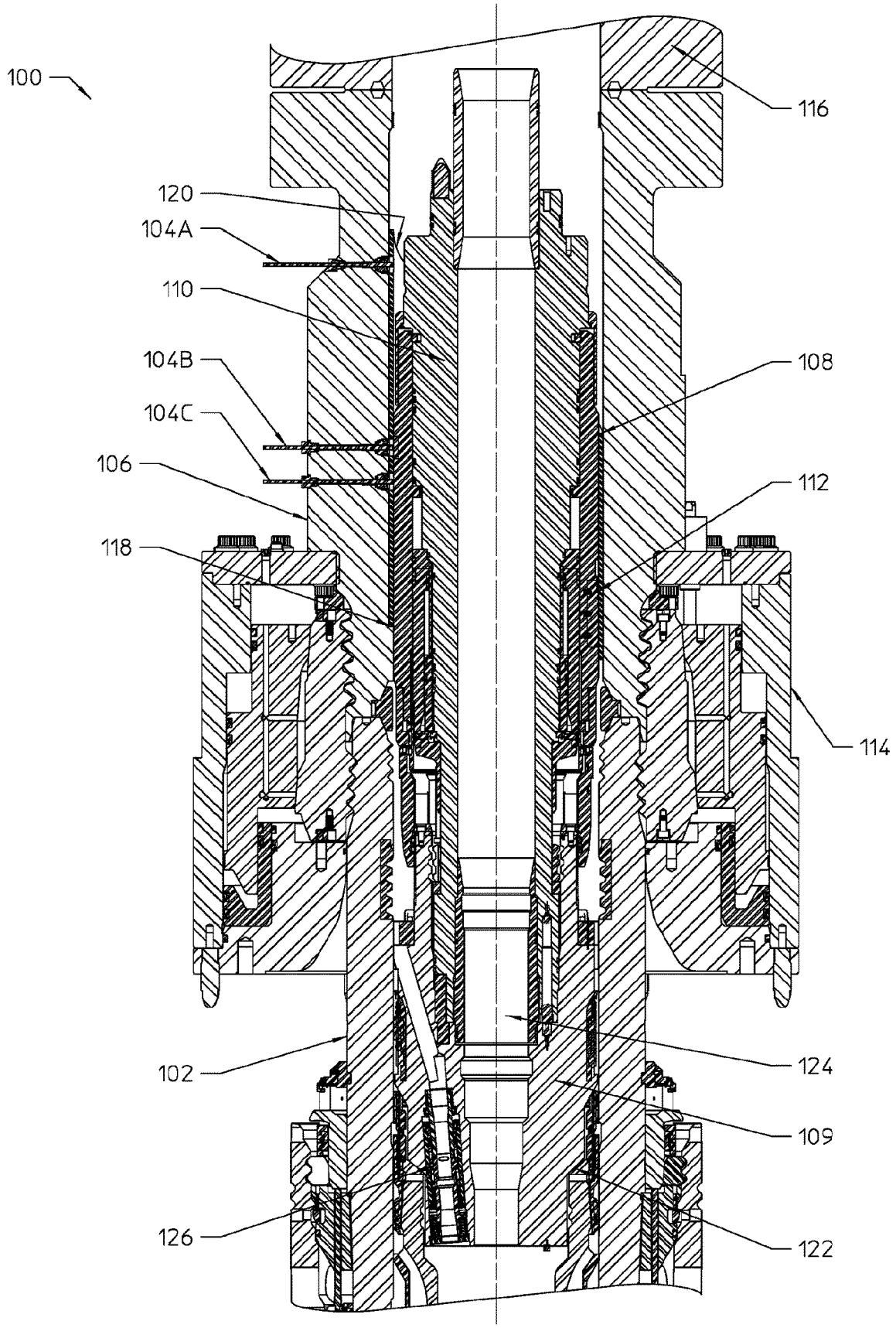
FIG. 1 is a cross-sectional view of the tubing hanger orientation system showing the orientation spool adaptor orienting a tubing hanger in a wellhead as optical sensors collect positional information.

Turning now to the drawings, FIG. 1 illustrates a subsea production system in which the disclosed orientation spool adaptor may be utilized 100. The system depicted in FIG. 1 may include a wellhead 102, an orientation spool adaptor system, and a landing string. The orientation spool adaptor system may include optical sensors 104A-104C, an orientation spool adaptor 106, and an orientation helix 108. The landing string may include a tubing hanger 109, a tubing hanger running tool 110 equipped with a spring-loaded orientation key 112.

As shown in FIG. 1, the orientation spool adaptor 106 may be connected to the wellhead 102. Alternatively, the orientation spool adaptor 106 may be connected to a horizontal Christmas tree (not shown), which in turn is connected to the wellhead. A connector 114 may be used to join and seal the orientation spool adaptor 106 to the wellhead 102 or horizontal tree (not shown). A blowout preventer (BOP) stack 116 may be connected to the orientation spool adaptor 106.

FIG. 1 also shows an orientation helix 108 located in the inner radius of the orientation spool adaptor 106. The helix 108 is supported by a shoulder 118 inside of the orientation spool 106. The helix 108 includes a helical profile 120. The helical profile 120 begins along the proximal end of the helix and rotates at a downward angle along the circumference of the helix and terminates further downhole at the distal end of the helix.

FIG. 1 illustrates the landing string 109-112. As stated above, the landing string includes a tubing hanger running tool (THRT) 110 and a tubing hanger 109. A controller (shown in FIG. 2) controls the vertical movement of the landing string 109-112 in the wellbore. During the orientation process, the landing string 109-112 is lowered into the bore of the orientation spool adaptor 106 and the bore of the wellhead 102. During orientation, the proximal portion of the THRT 110 is in the bore of the orientation spool adaptor 106 while the distal portion of the THRT 110 sits in the bore of the wellhead 102. In another embodiment, the distal portion of the THRT 110 and tubing hanger 109 may be in the bore of a horizontal Christmas tree (not shown) during orientation.

The tubing hanger 109 is attached to the distal portion of the THRT 110 above a landing shoulder 122 inside the bore of the wellhead 102. The tubing hanger 109 may suspend a tubing string 124 into and through the wellhead 102. In another embodiment the landing shoulder 122 may be inside the bore of a horizontal tree (not shown). In the illustrated embodiment, the tubing hanger 109 includes one or more communication lines 126 (e.g., hydraulic fluid lines, electrical lines, and/or fiber optic cables) disposed throughout that will communicatively couple to a tree (not shown). In another embodiment, the communication lines may couple to another type of subsea assembly such as a completion. The THRT 110 seats the tubing hanger 109 onto the shoulder 122 once the connection lines 126 in the tubing hanger are oriented to a defined position.

A spring-loaded orientation key 112 is attached to the sidewall of the THRT 110. The key 112 is biased in a radially outward direction. FIG. 1 illustrates the orientation key 112 extended and engaged inside the profile of the orientation helix 108. The orientation key 112 has a width sized to compliment the helical profile 120 associated with the orientation helix 108. When the key 112 is not engaged with the profile 120 of the orientation helix 108, the key's springs are retracted and the outer surface of the key is flush with the body of the THRT 110.

Several optical sensors 104A-104C are mounted through the orientation spool adaptor 106 and the orientation helix 108. The head of each optical sensor 104 is flush with the inner diameter of the orientation helix 108, where it may collect positional information about various subsea assemblies that enter the detection range of the sensors as they pass through the inner bore of the orientation spool adaptor 106. For example, at various points in the orientation process, the sensors may track the orientation of the tubing hanger 109, the tubing hanger running tool 110, the orientation key 112, a Christmas tree (not shown), and any other subsea assembly that possesses reference points detectable by the optical sensors. A person of ordinary skill in the art can appreciate that other types of sensors (such as sonic or magnetic sensors) may be used to collect positional information about subsea assemblies as they pass through the inner bore of the orientation spool adaptor 106.

The active part of the sensors 104 face the inner bore of the orientation spool adaptor 106. The sensors 104 have connection terminals that protrude from the outer diameter of the orientation spool adaptor 106. The connection terminals may be connected to cables that run to the surface, an ROV, or other device that allows the data collected from the sensors to be communicated to wellsite operators. the controller at the surface.

A person skilled in the art can appreciate that other types of alignment mechanisms other than an orientation helix 108 and key 112 may be implemented in conjunction with the positional sensors 104. The positional sensors 104 may track detectable reference points on any subsea assembly placed inside of the orientation spool adaptor 106 regardless of the alignment mechanism implemented. For example, the sensors 104 can be integrated to track the orientation of subsea assemblies engaged with a coiled tubing alignment mechanism, a torsional spring alignment mechanism, a plug-based alignment mechanism or another type of passive alignment mechanism. Additionally, the sensors 104 can be integrated with an active alignment mechanism.

Figure 2:
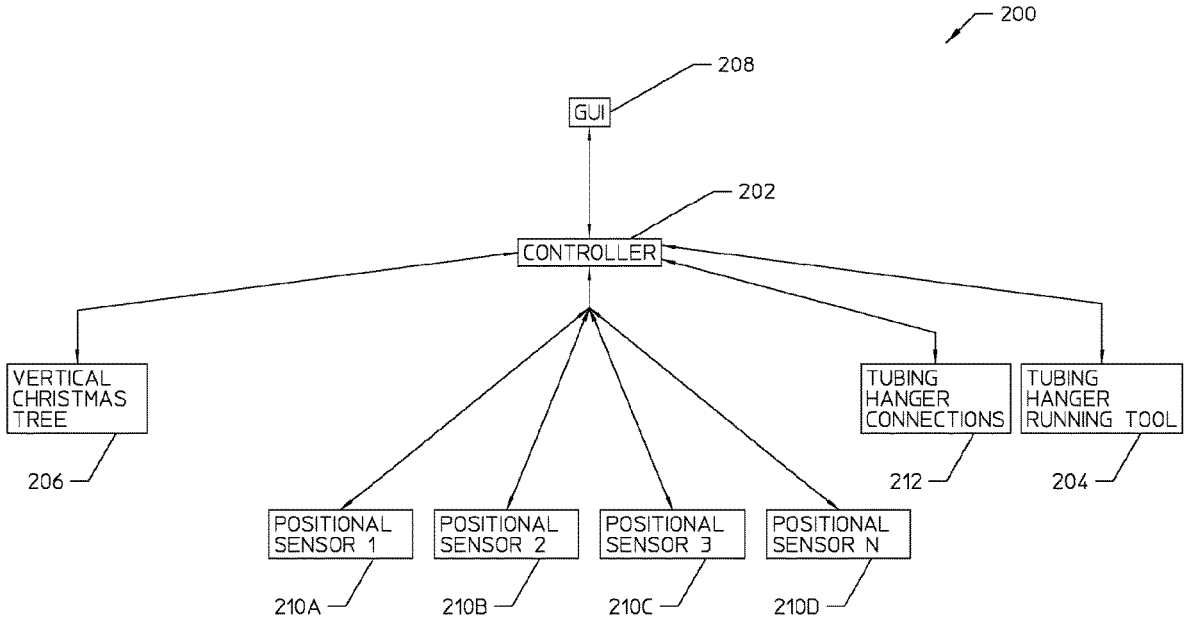
FIG. 2 is a schematic illustrating a controller communicating with the position sensors, tubing hanger, and other components of the tubing hanger orientation system as the tubing hanger is properly oriented within a wellhead.

FIG. 2 illustrates a control system 200 where a controller 202 transmits signals to and from components involved in orienting the connections of a tubing hanger 204 with complementary connections in a tree 206 or other subsea assembly. The controller 202 may be located at the surface. In another embodiment, the controller 202 may be located in an ROV (not shown). In another embodiment, the orientation components may be communicably connected to multiple controllers.

The controller 202 may be connected to or interface with a graphical user interface 208 located at the surface where operators can read signals received by the controller 202 during orientation. Operators can also use the interface 208 to program the controller 202 to send command signals to components involved in orientation. For example, operators can calibrate the sensors 104 and operate the THRT 110.

FIG. 2 shows the controller 202 communicably connected to the optical sensors 210. The controller 202 may direct sensor collection of reference points associated with the tubing hanger 109, THRT 110, and the orientation key 112 as the vertical and rotational positions of each component changes in the orientation spool adaptor 106 in relation to the sensors 104. The controller 202 may coordinate the activity of each sensor in relation to the other sensors.

The controller 202 is also communicably connected to the THRT 212. It may direct the THRT 212 to the appropriate vertical position inside of the orientation spool adaptor 106 during orientation. It may direct the THRT 212 to the appropriate vertical position inside of the wellhead as the THRT 212 lands the tubing hanger 109 in the wellhead 102. The controller 202 may use rotational data received from the sensors 210 in conjunction with the longitudinal data from the THRT 212 to perform various calculations such as the displacement measurements and installation times.

The connections housed in the tubing hanger 204 may also be communicably connected to the controller 202. During orientation, the tubing hanger 109 may be connected to the controller via connections in the tubing hanger running tool 204. In another embodiment where the tubing hanger is landed in the bore of a horizontal Christmas tree (not shown), the connections in the tubing hanger 204 may be connected to the controller 202 via connections in the horizontal Christmas tree. Communication with the connections housed in the tubing hanger 204 as the tubing hanger is seated in the horizontal tree indicates that the tubing hanger has been properly oriented.

The controller 202 may be communicably connected to a Christmas tree 206. Regardless of whether a horizontal tree (not shown) or vertical tree 206 is installed on the wellhead 102, the controller 202 may process signals to and from the Christmas tree 206 during installation or as subsea assemblies are connected to it. As shown in the illustrated embodiment, the controller 202 may coordinate the connection of a vertical tree 206 to the connections of a tubing hanger 204 installed inside of a wellhead 102. Alternatively, the controller 202 may coordinate the connection of a tubing hanger 204 to the connections of a horizontal tree (not shown) as the tubing hanger is installed inside the bore of the horizontal tree. A person skilled in the art can appreciate that the controller 202 may also communicate with other subsea assemblies such as an orientation helix 108 or a BOP 116.

A general description of a method for operating the orientation spool adaptor of FIGS. 1 and 2 will now be described. First the landing string 109-112 is lowered inside the orientation spool adaptor 106 until the sensors 104 indicate the landing string is in the proper vertical position for orienting the tubing hanger 109. The sensors 104 detect reference points from the tubing hanger 109 and the proximal end of the THRT 110 as they travel downhole through the bore of the spool 106 and into the wellhead 102. The sensors 104 also detect reference points that signify when the spring-loaded orientation key 112 outwardly projects into the helical profile 120 and engages the orientation helix 108.

Once the orientation key 112 engages the orientation helix 108, further vertical movement of the landing string 109-112 also drives rotational movement of the landing string. The orientation key 112 drives the THRT 110 and attached tubing hanger 109 to rotate relative to the stationary helix 108 as the orientation key 112 travels around the helical profile 120 until the tubing hanger 109 reaches a position defined by the sensors 104. The sensors 106 may track reference points on THRT 110 and/or key 112 to determine their change in position as the orientation helix 108 passively rotates the tubing hanger 109 to the landing orientation.

The THRT 110 lands the tubing hanger 109 in the defined position in the wellhead 102 while the sensors 104 continue to monitor position. Once the tubing hanger 109 is secured, the THRT 110 detached from the tubing hanger 109 and is pulled from the wellbore. The sensors 104 can then guide proper orientation of the connections of a vertical tree (not shown) with the corresponding connections of the tubing hanger 126 based on the positional information collected during orientation of the tubing hanger.

In another embodiment, a horizontal Christmas tree is installed between the wellhead 102 and the orientation spool adaptor 106 and the tubing hanger 109 is landed in the tree. In this embodiment, the orientation helix 108 and the orientation key 112 work much the same way and rotate the tubing hanger 109 to a position defined by the sensors 104. This position aligns the connections of the tubing hanger 126 with the complimentary connections in the horizontal Christmas tree (not shown). This position also guides the completion to be oriented to the defined position, allowing for the connections in the tubing hanger 126, horizontal tree (not shown), and completion (not shown) to be correctly made up.

Although the present disclosure and its advantages have been described in detail, it should be understood that various changes, substitutions, and alterations can be made herein without departing from the spirit and scope of the disclosure as defined by the following claims.

What is claimed is:

1. A system for aligning one or more connections between a tubing hanger and a subsea assembly, comprising:

(a) an orientation spool adaptor having one or more position sensors, which generate at least one signal;

(b) an orientation helix disposed inside an inner circumferential surface of the orientation spool adapter, wherein the one or more position sensors are disposed at or immediately adjacent an inner diameter of the orientation helix;

(c) an orientation key disposed on a tubing hanger running tool and adapted to couple the orientation helix to the tubing hanger; and (d) a controller in communication with the one or more position sensors;

wherein the one or more position sensors are configured to detect information indicative of a rotational orientation and/or a speed of the tubing hanger during rotation of the tubing hanger with respect to the orientation spool.

2. The system according to claim 1, wherein the controller is connected to a user interface for conveying real-time feedback of the at least one signal.

3. The system according to claim 1, wherein the one or more position sensors are further configured to detect information indicative of a location of the tubing hanger during rotation of the tubing hanger.

4. The system according to claim 1, wherein the controller operates the one or more position sensors to detect the rotational orientation of the tubing hanger during rotation of the tubing hanger.

5. The system according to claim 1 wherein the orientation spool adaptor is connected to a wellhead via a wellhead connector.

6. The system according to claim 1 wherein the one or more connections of the tubing hanger are aligned within a wellhead.

7. The system according to claim 1 wherein the one or more connections of the tubing hanger are aligned within a horizontal tree.

8. The system according to claim 1, wherein the orientation key is spring-loaded and biased in a radially outward direction to engage the orientation helix.

9. The system according to claim 1, wherein the at least one position sensor comprises multiple position sensors.

10. The system according to claim 9, wherein during rotation of the tubing hanger the orientation key and the orientation helix engage to rotate the tubing hanger to a position defined by at least one of the multiple position sensors.

11. The method of claim 9, wherein the multiple position sensors are located at different locations along an axial length of the spool adaptor.

12. A method for aligning one or more connections of a tubing hanger, comprising:

(a) lowering the tubing hanger toward a subsea assembly;

(b) coupling the tubing hanger to an orientation helix via an orientation key, wherein the orientation helix is coupled to an orientation spool adapter;

(c) obtaining information about the tubing hanger using at least one signal generated by at least one position sensor, wherein the at least one position sensor is disposed at or immediately adjacent an inner diameter of the orientation helix; and (d) rotating the tubing hanger using the orientation helix until the one or more connections of the tubing hanger are oriented to a predetermined position; wherein the obtaining information about the tubing hanger comprises obtaining information indicative of an orientation and/or a speed of the tubing hanger during the rotation of the tubing hanger using the orientation helix.

13. The method of claim 12 further comprising connecting the orientation spool adaptor to a wellhead via a wellhead connector.

14. The method of claim 12 further comprising sending real-time feedback of the obtained information about the tubing hanger to a controller.

15. The method of claim 12 further comprising obtaining information indicative of the location of the tubing hanger during rotation of the tubing hanger using the at least one signal generated by the at least one position sensor.

16. The method of claim 12 further comprising calibrating the at least one position sensor before lowering the tubing hanger.

17. The method of claim 12 further comprising calibrating the at least one position sensor to the position defined by the at least one position sensor, allowing for at least one of a flowline line, jumper, the orientation spool adapter, or another wellhead component to be correctly made up.

18. The method of claim 12 wherein rotating the tubing hanger to the defined position comprises, orienting the tubing hanger in a wellhead or in a horizontal tree.

19. The method of claim 12, wherein the orientation key is disposed on a tubing hanger running tool used to lower the tubing hanger.

20. The method of claim 12, wherein the at least one position sensor comprises multiple position sensors, and wherein the predetermined position is defined by at least one of the multiple position sensors.

* * * * *